United States Patent [19]

Morrow

[11] 4,344,447

[45] Aug. 17, 1982

[54] DOUBLE TWIST HAIR ROLLER

[76] Inventor: Willie L. Morrow, 4167 Market St., San Diego, Calif. 92102

[21] Appl. No.: 219,848

[22] Filed: Dec. 23, 1980

[51] Int. Cl.[3] ..... A45D 2/14

[52] U.S. Cl. ..... 132/42 R

[58] Field of Search ..... 132/42 R, 39, 42 A, 132/40

[56] References Cited

U.S. PATENT DOCUMENTS

| | | | |
|---|---|---|---|
| 2,415,586 | 2/1947 | Grant | 132/42 R |
| 2,421,287 | 5/1947 | Reininger | 132/42 R |
| 2,809,646 | 10/1957 | Solomon | 132/42 R |

FOREIGN PATENT DOCUMENTS

| | | | |
|---|---|---|---|
| 602577 | 8/1960 | Canada | 132/42 R |
| 976910 | 3/1951 | France | 132/42 R |

*Primary Examiner*—Hugh R. Chamblee
*Assistant Examiner*—Mickey Yu
*Attorney, Agent, or Firm*—Ralph S. Branscomb

[57] ABSTRACT

A hair roller is provided having a generally cylindrical body portion with two end caps which stretch a band of rubber or like resilient material across the surface of the body, the two end caps being rotatable in opposite directions to cause the band to stretch across the body in increasingly tight fashion without substantially displacing the central portions of the elastic, so that the hair thereon is not substantially disturbed.

5 Claims, 14 Drawing Figures

FIG. 1
FIG. 2
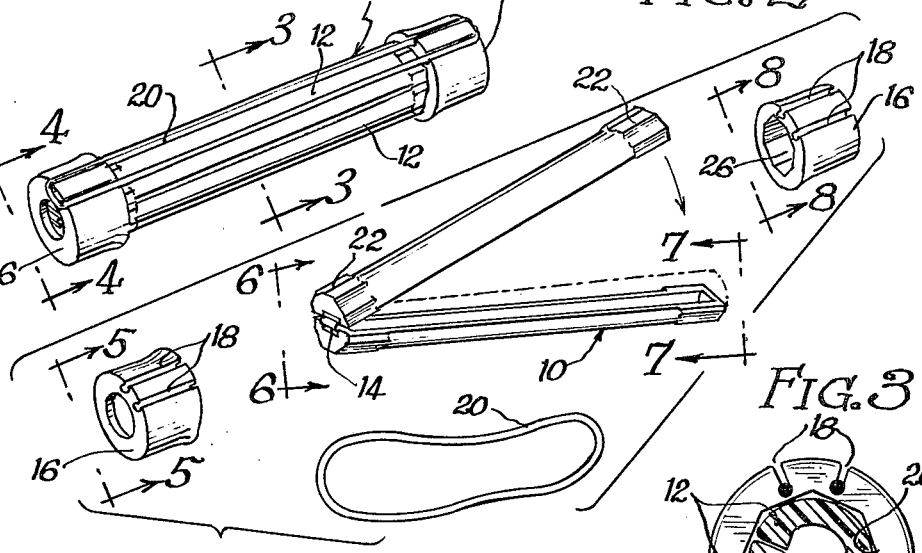
FIG. 3
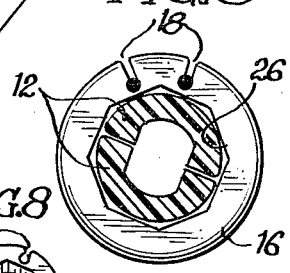
FIG. 4
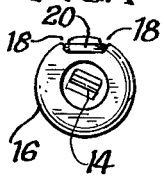
FIG. 5
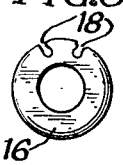
FIG. 6
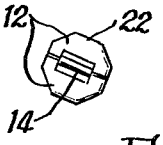
FIG. 7
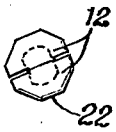
FIG. 8
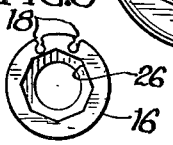
FIG. 9
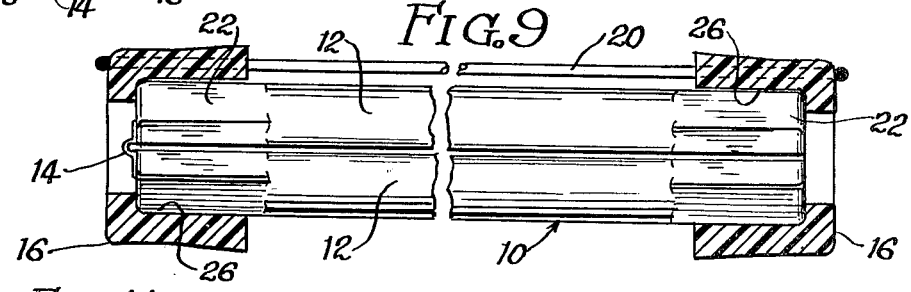
FIG. 11
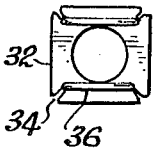
FIG. 10
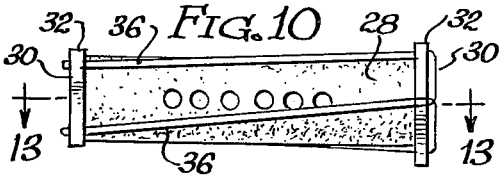
FIG. 12
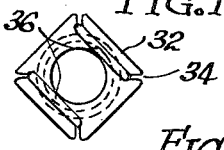
FIG 13
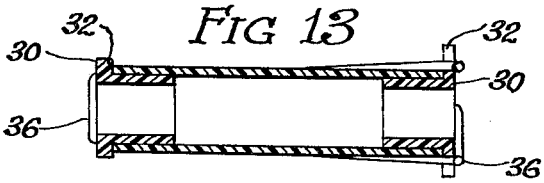
FIG. 14
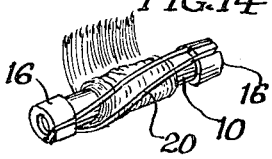

DOUBLE TWIST HAIR ROLLER

BACKGROUND OF THE INVENTION

The basic concept of a hair roller is a central drum or cylinder on which the hair is wrapped into a curl and retained by means of a secondary member comprising an elastic band or some type of pivotal strap or bar, in either instance the secondary member frictionally engaging the hair against the roller body.

Typically the device is of the type using an elastic band havine one end which rotates so that the elastic band may be engaged in the rotating end to basically secure the hair on the roller, and then the rotatable end can be adjusted slightly to increase the tension on the band. However, when it does this, the hair which is already rolled on the central drum is displaced either more tightly or more loosely around the drum, so that the tightening function automatically also affects the tightness of the hair roll, which is not desirable.

It is also true of most conventional rollers that it is not possible to entirely remove the band structure from the roller drum in order to provide maximum agility and flexibility of rolling the hair.

SUMMARY OF THE INVENTION

The present invention solves the above-stated problems by providing a hair roller which in its preferred embodiment comprises a split cylinder hinged at one end by an integral strap, both ends of the cylinder being octagonal and cross section. Two end caps, also cut with octagonal cross sections, are insertable over the ends of the cylinder, and by virtue of a pair of grooves longitudinally extended in both end caps, a continuous elastic band passes through these grooves to be connected by both end caps across the face of the roller body or cylinder. By rotating either one or both of these end caps in opposite directions, tension will be produced on the band spanning the cylnder which is independent of the degree of curl of the hair because the band can be tightened so that it neither advances nor retreats on the roller by twisting both end caps in opposite directions an equal distance.

BRIEF DESCRIPTION OF THE DRAWINGS

FIG. 1 is a perspective view of the preferred embodiment of the invention;

FIG. 2 is an exploded perspective of the curler of FIG. 1;

FIGS. 3 through 8 are sectional views taken along similarly numbered section lines in FIGS. 1 and 2;

FIG. 9 is a side elevation view of the embodiment of FIGS. 1 through 8 with portions of the end cap in section and the central portion cut away;

FIG. 10 is a side elevation view of a modification of the invention;

FIG. 11 is a view from the left end of FIG. 10;

FIG. 12 is a view from the right end of FIG. 10;

FIG. 13 is a section taken along line 13—13 of section 10;

FIG. 14 illustrates the first embodiment of the invention in use.

DETAILED DESCRIPTION OF THE PREFERRED EMBODIMENT

The invention is best shown in detail in FIG. 2 wherein it can be seen that in the preferred embodiment a central, generally cylindrical body portion 10 is defined in two identical halves 12 which are connected by a hinge or strap 14 which is an integral part of the two halves 12 by virtue of the entire structure being molded in plastic. The hinge of course permits the halves 12 to separate as shown in FIG. 2, and two identical end caps 16 each are provided with longitudinally extended slots 18 through which can be engaged the ends of an elastic band 20.

Each of the ends 22 of the central body portion 10 is slightly enlarged and octagonally shaped to conform to the octagonal interior 26 of the end caps, so that once the roller is assembled as in FIG. 1, either or both caps can be slipped slightly off the ends of the body portion 10 and rotated relative to the other end cap to define a helical twist in the band as shown in FIG. 14. It will be noted that because both end caps can rotate, if they are both rotated in opposite directions an equal amount, the central portion of the band on the roller will not be axially displaced in any substantial amount, so that the degree of curl of the hair need not be affected by the degree of tension achieved in the band.

Naturally, other shapes other than octagonal could be used with the same effect, and it would be possible to leave a portion of the very outside ends of the body portion 10 cylindrical so that the end caps may be extended free of the octagonal detent structure without having to be removed entirely from the body portion.

Turning to FIGS. 10 through 13, a modification of the invention is provided wherein a central straight cylinder 28 mounts end plugs 30 which are generally T-shaped in cross section having an outer flange 32 which is square in plan form as can be seen in FIGS. 11 and 12 and has notches 34 at the corners.

A pair of elastic bands 36 pass through these notches as shown in FIGS. 11 through 13, and similar to the action of the first embodiment illustrated in FIG. 14, the end plugs 30 of the second embodiment can be twisted in opposite directions as shown in FIG. 10 to create a tension on the hair which is independent of the direction the hair is urged on the curler.

In both embodiments, a simply manufactured and effective curler is provided as a cylinder having end caps rotatable in opposite directions to tension the band stretching therebetween without affecting the curl on the hair. In the first embodiment, more positive control of the hair can be achieved by engaging a lock of hair between the two hinged halves 12 and securing the halves together with the end caps 16, while simultaneously adjusting the tension on the band 20 spanning these end caps.

What is claimed is:

1. A hair curler comprising:

(a) an elongated body;

(b) an elastic band extendable to the substantial length of said body;

(c) end caps engageable on the ends of said body to stretch said band therebetween; and (d) the ends of said body being polygonal and the inside of said end caps being polygonal to mate with the ends of said body such that said end caps can be removed from said body and twisted to define a helical curve in said band around said body and be locked in said twisted position to tighten said band against said body.

2. Structure according to claim 1 wherein said body is longitudinally split into two parts with the ends of each part defining a portion of a polygon and said end caps when engaged hold said body together.

3. A hair curler comprising:

(a) an elongated body;

(b) an elastic band extendable the substantial length of said body;

(c) a pair of band retaining caps engaged on the ends of said body to stretch said band therebetween, said caps being rotatively adjustable about the longitudinal axis of said body and each being securable against rotation in one of a plurality of selectable rotatably adjusted positions so that said band can be stretched helically around said body and positively retained in the helical position, and;

(d) said caps being removably fitting over the ends of said body and releasably held in place by said band, and said caps and body ends have a generally mating cross section that is non-circular to prevent counter-rotation of said caps once they are fixed.

4. Structure according to claim 3 wherein said cross sections are generally octagonal to provide eight discrete, rotatively selectable positions.

5. Structure according to claim 3 wherein said caps each have a square flanged base to provide a gripping area in use and said bases each define a pair of recessed grooves to seat a band such that each curler can mount two elastic bands which are simultaneously twisted into a helix when said caps are rotatably adjusted.

* * * * *